US006131642A

United States Patent [19]

Welfonder

[11] Patent Number: 6,131,642

[45] Date of Patent: Oct. 17, 2000

[54] LOCKING DEVICE

[75] Inventor: Konrad Welfonder, Bremerhaven, Germany

[73] Assignee: Hunter Douglas International N.V., Netherlands Antilles

[21] Appl. No.: 09/405,468

[22] Filed: Sep. 24, 1999

[30] Foreign Application Priority Data

Sep. 28, 1998 [EP] European Pat. Off. ..... 98203222

[51] Int. Cl.[7] ..... E06B 9/56

[52] U.S. Cl. ..... 160/301; 160/305

[58] Field of Search ..... 160/301, 302, 160/305, 291, 297, 300

[56] References Cited

U.S. PATENT DOCUMENTS

| | | |
|---|---|---|
| 4,466,475 | 8/1984 | Saito et al. . |
| 4,662,423 | 5/1987 | Ishii . |

FOREIGN PATENT DOCUMENTS

| | | |
|---|---|---|
| 63401/94 | 12/1994 | Australia . |
| 087146 | 8/1983 | European Pat. Off. . |
| 419017 | 3/1991 | European Pat. Off. . |
| 356403 | 12/1992 | European Pat. Off. . |
| 915384 | 7/1954 | Germany . |
| 156500 | 6/1921 | United Kingdom . |
| 189412 | 7/1923 | United Kingdom . |
| 1594138 | 7/1981 | United Kingdom . |
| 2199065 | 6/1988 | United Kingdom . |

*Primary Examiner*—David M. Purol
*Attorney, Agent, or Firm*—Dorsey & Whitney LLP

[57] ABSTRACT

A locking device (38) for locking a hollow longitudinally extending tubular roller (12) of a shade (16) of an architectural covering (1) releasably in any unwound position of the shade. The locking device (38) includes a center shaft (28) concentrically arranged within the roller and a return spring (32), capable of being operatively interposed between the roller (12) and the center shaft (28), for biasing the roller (12) towards a fully wound position of the shade (16). It also includes a disc (42) rotatably mounted on the center shaft (28) radially adjacent a first portion (12A) of the length of a circumferential inner surface of the roller (12) and a plurality of detent projections (82, 86) integrally formed on a second portion (12B) of the length of the inner surface of the roller (12). A cam member (44) is mounted on the center shaft (28), so as to be able to carry out sliding movement transversely, preferably laterally, of the center shaft (28), between two end positions. The cam member (44) has a lateral cam projection (70, 90) for engaging the detent projections (82, 86). A friction arrangement (47, 48, 49) is provided between the disc (42) and the roller (12), for yieldingly engaging the disc (42) to rotate with the roller (12) in either of two opposite rotational directions. The friction arrangement includes a cylindrical cavity (47) housing a coaxially-extending compression spring (48) and a ball (49), radially outwardly of the compression spring; the ball being biased against, and frictionally engaging, the first portion (12A) of the inner surface of the roller (12). The disc (42) has a face (51) that confronts the cam member (44) and is provided with a guide track (52) forming a closed loop in the face of the disc and the cam member (44) is provided with a pawl (74) engaged in the guide track (52) to move the cam member (44) between the two end positions in response to changes in rotational direction of the roller.

11 Claims, 4 Drawing Sheets

LOCKING DEVICE

CROSS-REFERENCE TO RELATED APPLICATION

This application corresponds to and claims priority to European Application No. 98203222.9, filed Sep. 28, 1998. This European application is hereby incorporated by reference as though fully set forth herein.

FIELD OF THE INVENTION

This invention relates to a locking device for a rotatable hollow tubular roller of an architectural covering, especially a covering for an architectural opening, such as a roller blind or shade. This invention particularly relates to a locking device, within the roller, capable of locking the architectural covering in any position.

BACKGROUND OF THE INVENTION

Locking devices for rollers of architectural coverings are well known. One such device capable of locking the roller of a window shade in different positions is described in EP 0 087 146. The device has a coil spring or wrap spring brake and a cam sleeve with a bifurcated cam groove engaged by a cam pin, connected to the roller. When the roller rotates, the cam pin moves along the cam groove and pushes the cam sleeve to loosen the coil spring brake when the shade is being pulled down and when it is released after being pulled down in order to roll it up. When the shade is pulled down from its uppermost position and than released, the coil spring brake is tightened and locks the roller.

Another locking device, described in EP 0 356 403, has two sets of corresponding opposed teeth and a cam sleeve with a bifurcated cam groove engaged by a cam pin connected to the roller of a window shade. When the roller rotates, the cam pin moves along the cam groove and pushes one set of teeth to engage the other set of teeth when the shade is released at a given position, after being pulled down. The shade is than locked at that position. The cam pin moving along the cam groove drives one set of teeth either into or out of engagement with the other set of teeth as required for locking or for raising or lowering the shade.

Yet another locking device, described in U.S. Pat. No. 4,662,423, uses a changeover wheel with an axially-projecting pin and a guide wheel with a guideway, including guide portions made of a leaf spring. The free end of the pin moves along the guide path of the changeover wheel. The pin is biased radially outwardly by a coil spring, but this bias can be overridden by the leaf spring guide portions which will move the pin radially inwardly, against the bias of the coil spring. The guide wheel is connected to the roller of a window shade and rotates when the shade is raised or lowered, but a coil spring brake allows the changeover wheel only to rotate when the shade is lowered. In this regard, when the shade is lowered, the roller and the guide wheel rotate, and the guideway moves the pin and thus the changeover wheel to a first rest position. This connects the changeover wheel to the rotating guide wheel, causing it also to rotate. The rotation of the roller also loosens the coil spring, so that the changeover wheel is free to rotate. When the shade is released after being lowered so that it starts moving up, the guide wheel is rotated so that the pin moves from the first rest position to a second rest position in the guideway. As result, the coil spring is tightened, so that the changeover wheel cannot rotate. Since the changeover wheel is still connected to the guide wheel by the pin and the guide wheel is connected to the roller, all rotation is stopped by the tightening of the coil spring. To raise the shade, it is first pulled down slightly, causing the pin to move from the second rest position and to be free to move radially outwardly under the bias of the coil spring, thereby freeing the guide wheel to rotate. Since the guide wheel is connected to the roller of the shade, both now rotate and the shade is raised.

These locking devices depend on coil springs or sets of interengaging teeth to stop rotation of a roller. Such devices tend, therefore, to be rather bulky and to take up valuable space in the hollow tubular roller, on which a shade is wound. Also such devices tend to be rather complicated and time consuming to assemble, especially if the faulty assembly of such devices is to be minimized.

SUMMARY OF THE INVENTION

According to the present invention there is provided a locking device for locking a hollow longitudinally extending tubular roller of a shade of an architectural covering, said locking device comprising:

said roller;

a center shaft concentrically arranged within said roller;

a return spring, capable of being operatively interposed between said roller and said center shaft, for biasing said roller towards a fully wound position of said shade;

a disc rotatably mounted on said center shaft radially adjacent a first portion of the length of a circumferential inner surface of said roller;

at least one detent projection on a second portion of the length of the inner surface of said roller;

a cam member, mounted on said center shaft, so as to be able to carry out sliding movement transversely, preferably laterally, of said center shaft, between two end positions; said cam member having a lateral cam projection for engaging said detent projection; and means, between said disc and said roller, for yieldingly engaging said disc to rotate with said roller in either of two opposite rotational directions;

said disc having a face that confronts said cam member and is provided with a guide track; and said cam member being provided with a pawl engaged in said guide track to move said cam member between said two end positions in response to changes in rotational direction of said roller, whereby said roller may be locked releasably in any unwound position of the shade.

With such a construction it is possible to provide a locking device that takes up less space within the roller, is easier to assemble and is more reliable.

Advantageously, the means for yieldingly engaging the disc to rotate with the roller is a friction means, especially a friction means that includes a cylindrical cavity housing a co-axially extending compression spring and a ball, radially outwardly of the compression spring; the ball being biased against, and frictionally engaging, the first portion of the inner surface of the roller.

BRIEF DESCRIPTION OF THE DRAWINGS

Further aspects of the invention will be apparent from the detailed description below of particular embodiments and the drawings thereof, in which.

DETAILED DESCRIPTION OF THE INVENTION

Figure 1:
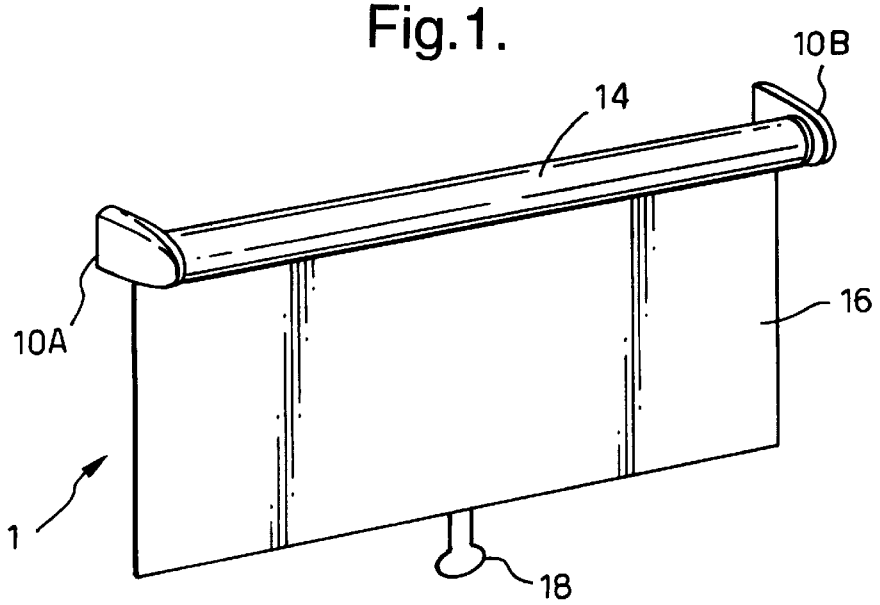
FIG. 1 is a schematic perspective view of a roller blind for a window with a longitudinally-extending rotatable hollow tubular roller containing a locking device of this invention.

FIG. 1 shows a roller blind, generally 1, the ends of which are attached to a pair of conventional, left and right brackets 10A and 10B for mounting the roller blind 1 on a wall, adjacent to a window. The roller blind 1 has an elongate rotatable hollow tubular roller 12 which cannot be seen in FIG. 1 because a top portion 14 of a shade 16 is wound about the roller 12. The top end of the shade 16 is attached to the roller 12 in a conventional manner. A conventional pull-tab 18 is provided at the bottom end of the shade 16.

Figure 2:
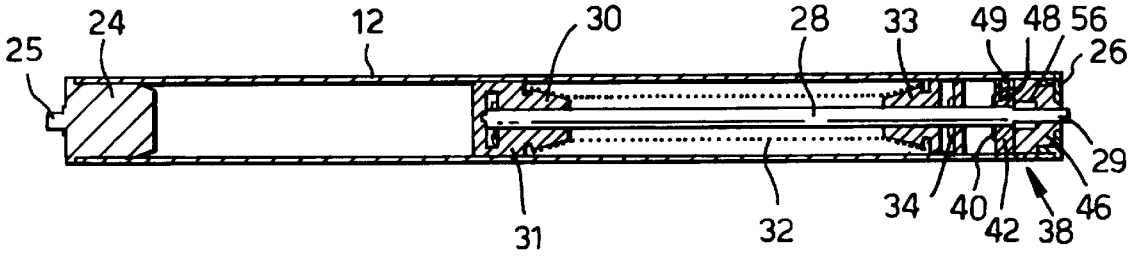
FIG. 2 is a longitudinal schematic cross-section of the roller of FIG. 1, showing its locking device.
Figure 4:
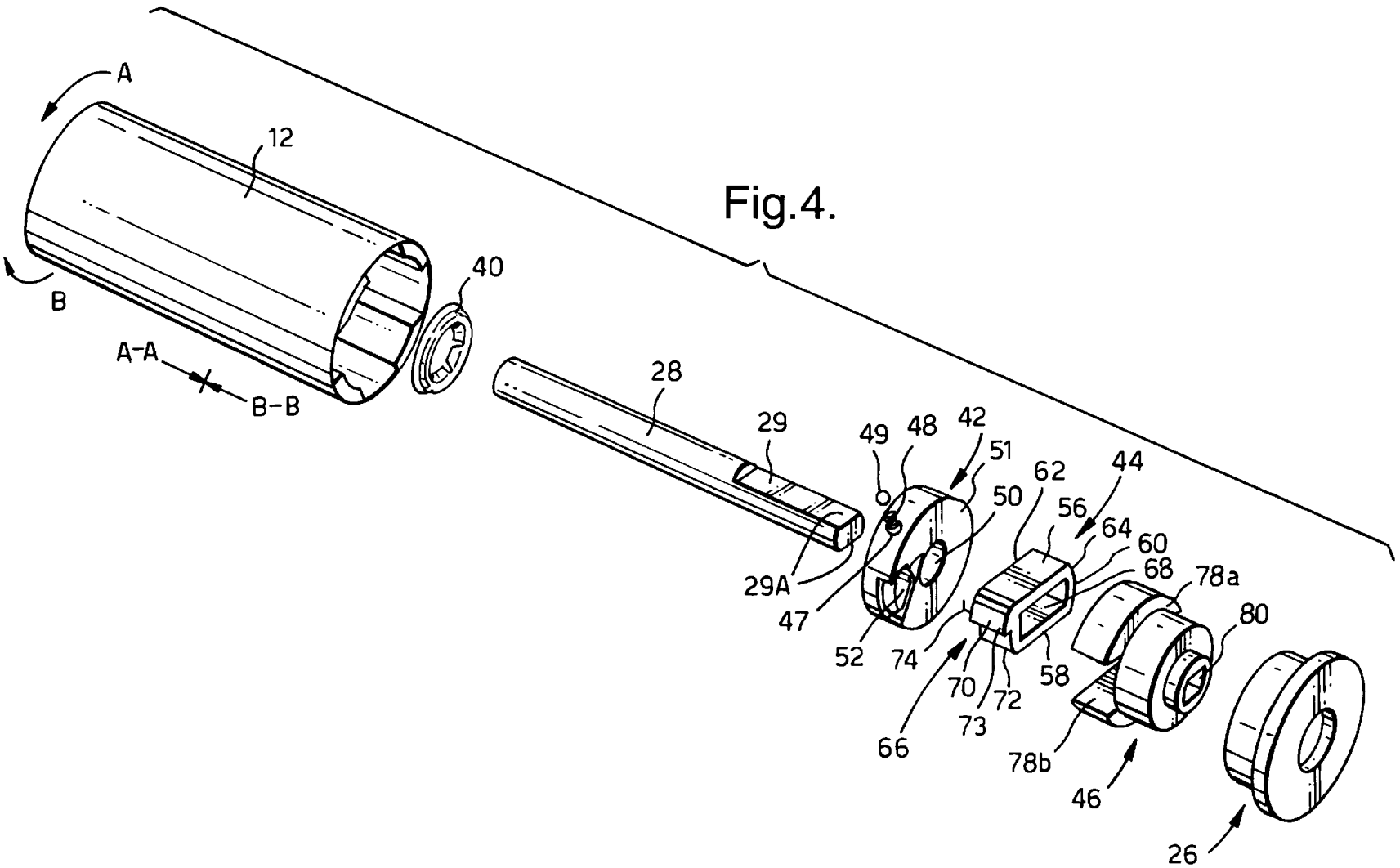
FIG. 4 is an exploded perspective view of an end portion of the roller and the locking device of FIG. 2.

FIGS. 2 and 4 show the interior of the longitudinally-extending roller 12. Within the left end portion of the roller 12, as best seen in FIG. 2, is a coaxially-extending journal end member 24 which is fixed to the roller 12 and is therefore rotatable therewith. A longitudinally-extending journal spigot 25 on the left end of the end member 24 rotatably engages the adjacent left bracket 10A (not shown), so that the end member 24 and roller 12 are rotatably journaled relative to the left bracket 10A.

Within the right end portion of the roller 12, as best seen in FIG. 4, is an end cap 26. The end cap 26 is non-rotatably mounted on the right end of a fixed longitudinally-extending center rod or shaft 28, concentrically provided within the roller 12, and the roller can rotate around the end cap 26. A flattened right longitudinal end portion 29 of the center rod 28 has parallel flat surfaces 29A on opposite longitudinal sides, preferably horizontally-extending parallel flat surfaces 29A on the top and bottom, and is preferably of rectangular cross-section. The right end portion 29 of the center rod 28 engages non-rotatably a corresponding, preferably rectangular, opening in the adjacent right bracket 10B (not shown), so that the center rod 28 is non-rotatably connected to the right bracket 10B, with the roller 12 being journaled relative to the center rod.

At the left end of the center rod 28 is a coaxially-extending first spring retainer 30 which is non-rotatably secured to the center rod 28 and the left end of which is retained axially in place by a first circlip 31 on the center rod. The right end of the first spring retainer 30 holds the left end of a return spring 32, such as a conventional coil spring. The return spring 32 is wound about the center rod 28 and used to drive rotation of the roller 12 (in direction B in FIGS. 4–6) in order to wind up the shade 16 about the roller. The right end of the return spring 32 is held by the left end of a coaxially-extending second spring retainer 33 which is rotatably positioned on the center rod 28 and the right end of which is retained axially in place by a second circlip 34 on the center rod. The second spring retainer 33 also engages, preferably is connected to, and rotates with, the interior surface of the roller 12. On the center rod 28, between the second spring retainer 33 and the end cap 26, is a locking device, generally 38, of this invention. The locking device 38 is prevented from moving longitudinally or axially to the left by a third circlip 40 which is to the left of the locking device on the center rod 28.

The locking device 38, shown in greater detail in FIGS. 3–7, serves as a releasable bearing for rotation of the roller 12 about the fixed center rod 28. In use, one can pull downwardly on the tab 18 to lower or unwind the shade 16, and the locking device 38 holds the roller 12 and thereby the shade in that position. In order to raise or wind up the shade 16, one can pull down again on the tab 18 to unlock the locking device 38, and the spring 32 causes the roller 12 to rotate and the shade 16 to be raised. Rotation of the roller 12 can be stopped in any desired position of either retracting or unwinding the shade 16 by operation of the locking device 38.

Figure 3:
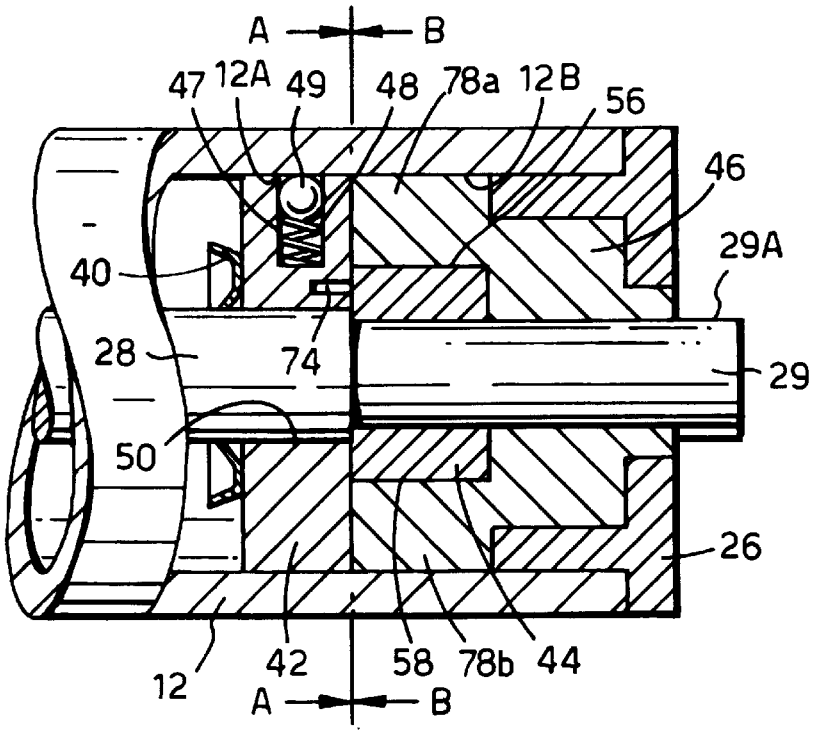
FIG. 3 is an enlarged detail of a longitudinal schematic cross-section of the locking device as shown in FIG. 2.

As best shown in FIGS. 2–4, the locking device 38 comprises the following coaxial elements on the center rod 28: a disc 42 which can rotate about the center rod 28 and the outer circumference of which fits closely within the roller 12; a cam 44 which is to the immediate right of the disc 42 and cannot rotate about the center rod 28; and a cam retainer 46 which is to the immediate right of the cam 44 and also cannot rotate about the center rod 28. The disc 42 has a radially inwardly-extending, cylindrical cavity 47 on its outer circumference. The cavity 47 holds a coaxially-extending compression spring 48 and a ball 49 that is positioned radially outward of the compression spring. The compression spring 48 biases the ball 49, so that it extends outwardly of the channel 47 and is urged against, and frictionally engages, a radially adjacent, first portion 12A of the length of the circumferential inner surface of the roller 12, so that the disc 42 rotates with the inner surface of the roller 12 about the center rod 28. In this regard, the first portion 12A of the inner surface of the roller 12, against which the ball 49 is urged by the spring 48, is preferably a relatively smooth surface which may, however, be roughened to increase its frictional engagement with the ball 49. The compression spring 48, when there is a force restraining rotation of the disc 42 with the first portion 12A of the inner surface of the roller 12, allows the ball 49 to be forced inwardly into the cavity 47, so that the disc 42 is disengaged from the inner surface of the roller and remains stationary relative to the rotating roller 12.

Figure 5:
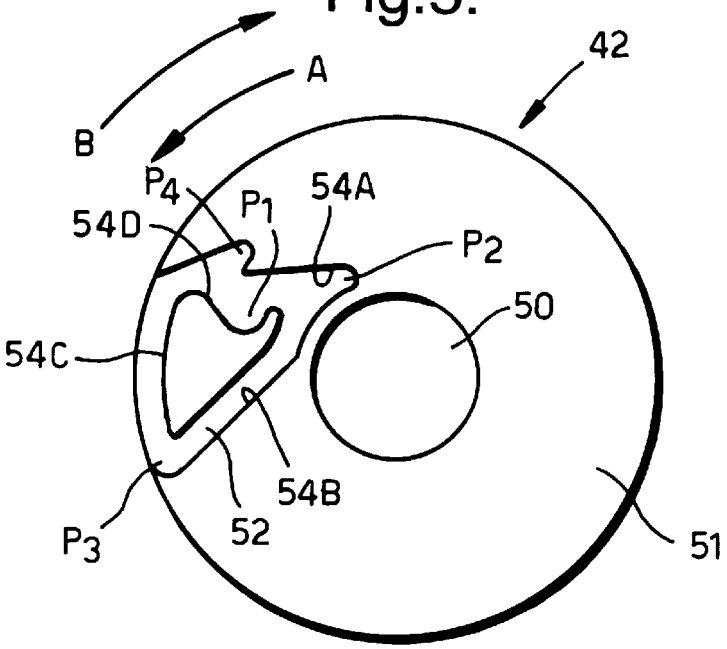
FIG. 5 is a face view of the disc of the locking device of FIG. 2, carrying the guide channel.

As shown in FIGS. 3–5, the disc 42 also has a centrally located, longitudinally-extending round bearing hole 50 through it, in which is located the coaxial center rod 28. The right side or axial face 51 of the disc 42 has a guide channel or track 52 in it. As best seen from FIG. 5, the guide channel 52 is a closed loop that does not circumambulate, cross or intersect the bearing hole 50 but occupies approximately one quarter of the right side face 51 of the disc 42.

As best shown in FIG. 4, the cam 44, that is to the right of the disc 42 and confronts its right side face 51, has an outer diameter that is smaller than the diameter of a radially adjacent, second portion 12B of the length of the circumferential inner surface of the roller 12. The cam 44 has a top surface 56, a bottom surface 58, a right side face 60, a left side face 62, a rearwardly-extending radial surface 64, a frontally-extending radial surface 66, and a longitudinally-extending first substantially rectangular hole 68, through it. The first rectangular hole 68 of the cam 44 has a transverse length, preferably a lateral length, that is longer than that of the flattened right end portion 29 of the center rod 28, located in the first rectangular hole, but the first rectangular hole 68 has substantially the same width as the flattened right end portion 29 of the center rod 28, between the parallel flat surfaces 29A. As a result, the cam 44 cannot rotate about the fixed center rod 28 in its first rectangular hole 68, but it can slide transversely, preferably laterally, on the parallel flat surfaces 29A of the flattened right end portion 29 of the center rod in its first rectangular hole between the transverse, preferably lateral, ends of its rectangular hole 68.

The rearwardly-extending radial surface 64 of the cam 44 is rounded and extends between the top and bottom cam surfaces 56 and 58. The frontally-extending radial surface 66 of the cam 44 has an outer cam projection surface 70 and first and second inner cam surfaces 72 and 73, respectively below and above the outer cam projection surface 70 as shown in FIG. 4. On the left face 62 of the cam 44 is a longitudinally- or axially-projecting pawl 74 which moves within, and is engaged by, the adjacent guide channel 52 in the right face 51 of the disc 42 upon rotation of the disc with the roller 12.

As seen from FIGS. 3 and 4, the left side of the cam retainer 46, adjacent the right face 60 of the cam 44, has two partly cylindrical, longitudinally-extending projections 78*a* and 78*b* that are transversely, preferably vertically, spaced apart and have facing parallel, preferably horizontally-extending, surfaces between them. Between the facing surfaces of the two partly cylindrical projections 78*a* and 78*b*, the cam 44 is accommodated with its transversely opposite, top and bottom surfaces 56 and 58 slidably engaging the adjacent facing surfaces of the two partly cylindrical projections. The end cap 26 engages the right side of the cam retainer 46, so as to prevent the cam retainer and the locking device 38 from moving longitudinally to the right on the center rod 28. The cam retainer 46 has an outer diameter that is somewhat smaller than the diameter of the radially adjacent, second portion 12B of the inner surface of the roller 12.

The cam retainer 46 also has a longitudinally-extending second rectangular hole 80 extending centrally through it. The flattened right end portion 29 of the fixed center rod 28 is also located within the second rectangular hole 80. The dimensions of the second rectangular hole 80 and of the flattened right end portion 29 of the center rod 28 are matched in order to provide a sufficiently tight fit between them, so that the cam retainer 46 does not rotate about the center rod 28. Thereby, the partly cylindrical projections 78*a* and 78*b* of the cam retainer 46 prevent the transversely opposite, top and bottom surfaces 56 and 58 of the cam 44 and the cam 44 itself from rotating about the center rod 28 without hindering the transverse, preferably lateral, movement of the cam 44 and its pawl 74, relative to the disc 42 and its guide channel 52, between the partly cylindrical projections. Such guidance of transverse, preferably lateral, movement of the cam 44 by the cam retainer 46 is preferably in addition to the guidance of transverse, preferably lateral, movement of the cam 44 by the parallel surfaces 29A of the flattened right end portion 29 of the center rod 28, but such guidance of transverse, preferably lateral, movement by the cam retainer 46 can also replace the guidance of transverse, preferably lateral, movement by the parallel surfaces 29A of the center rod 28.

FIG. 5 shows the right face 51 of the disc 42 with its guide channel 52. Different positions P1–P4 of the guide channel 52 are shown, in which the longitudinally-projecting pawl 74 of the cam 44 can be held when the pawl 74 moves in the guide channel with rotation of the disc 42 with the roller 12. In this regard, the engagement of the pawl 74 and position P2 of the guide channel 52 will prevent the disc 42 from rotating in the direction of arrow A more than about 180° and the engagement of the pawl 74 and position P1 of the guide channel 52 will prevent the disc 42 from rotating in the direction of arrow B more than about 180° as described below.

Figure 6A:
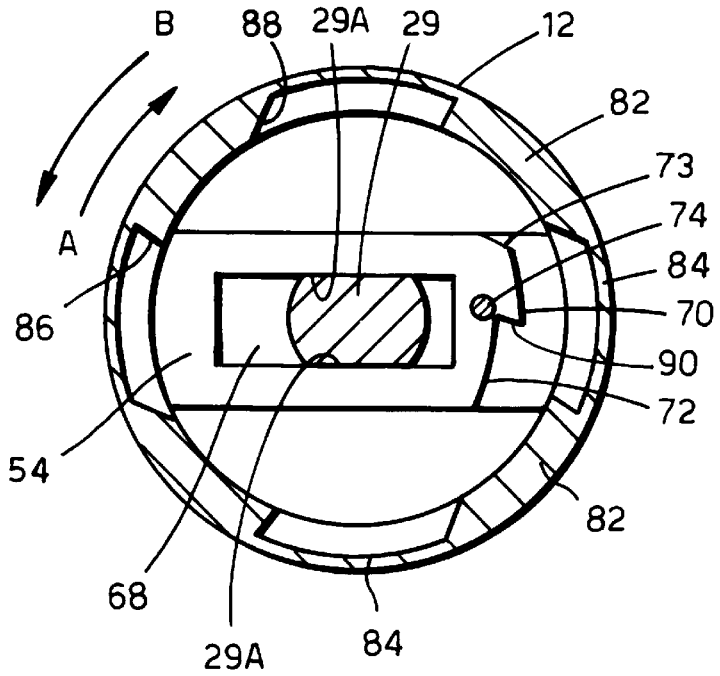
FIGS. 6A and 6B are lateral cross-sections along line A—A in FIG. 2 of the roller and its locking device, showing the cam of the locking device in different positions of operation, relative to the roller.
Figure 6B:
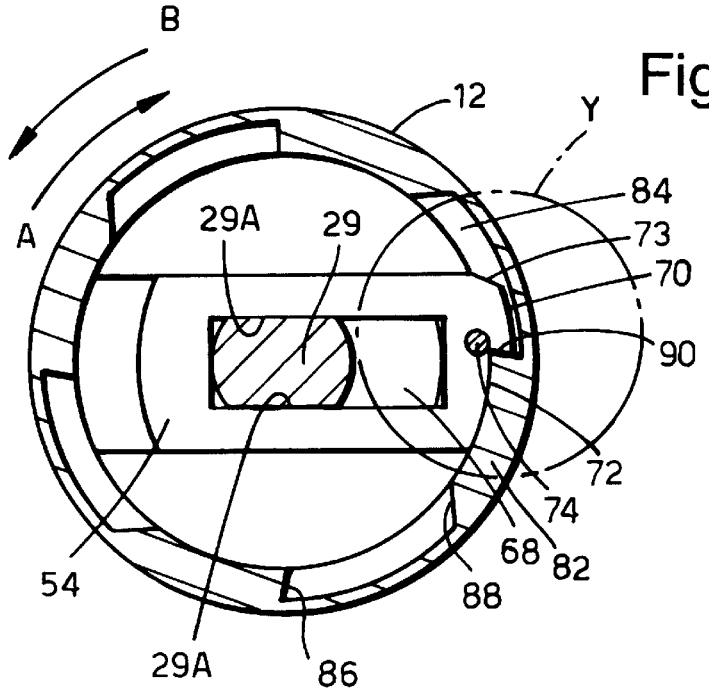

As best seen from FIGS. 6A and 6B, the second portion 12B of the inner surface of the roller 12 is provided with a plurality of spaced apart, radially inwardly-extending detent projections 82 about the cam 44 of the locking device 38 and with flats 84 between the projections. Such detent projections 82 could be formed on a separate element inserted in the roller 12 but preferably are integrally formed on the inner surface of the roller. The counter-clockwise side 86 of each detent projection 82 preferably forms an acute angle with the adjacent flat 84, while the clockwise side 88 of each detent projection 82 preferably forms an obtuse angle with the adjacent flat 84. In addition, the clockwise side 90 of the of the outer cam projection surface 70 of the frontally-extending radial surface 66 of the cam 44 preferably forms an acute angle with the adjacent clockwise first inner cam surface 72 of the cam 44 while the counter-clockwise second inner cam surface 73 of the cam 44 preferably forms an obtuse angle with the outer cam projection surface 70. As a result, the clockwise sides 88 of the detent projections 82 easily guide the second inner cam surface 73 and the outer cam projection surface 70 of the cam 44 radially inwardly, out of the flats 84, and the counter-clockwise sides 86 of the detent projections 82 do not engage the outer cam projection surface 70 as the roller 12 rotates clockwise, in the direction of arrow A in FIG. 6B, about the cam 44 and the center rod 28 when the pawl 74 of cam 44 is in position P3 in the guide channel 52 of the disc 42. However, the counter-clockwise side 86 of one of the detent projections 82 engages (i.e., hooks) the clockwise side 90 of the outer cam projection surface 70 of the cam 44 while the clockwise sides 88 of the detent projections 82 otherwise allow the counter-clockwise second inner cam surface 73 of the cam 44 to slide over them as the roller 12 rotates counter-clockwise, in the direction of arrow B in FIG. 6B, about the cam 44 and the center rod 28 when the pawl 74 of cam 44 is in position P3 in the guide channel 52 of the disc 42.

FIGS. 6A and 6B also show that the flattened right end portion 29 of the center rod 28 is at the center of the roller 12 and within the first rectangular hole 68 of the cam 44. The outer cam projection surface 70 of the frontally-extending radial surface 66 of the cam 44 has substantially the same radius as the flats 84 of the inner surface of the roller 12, and the radius of the clockwise first inner cam surface 72 of the frontally-extending radial surface 66 is substantially the same as the radius of the inwardly facing surface of the detent projections 82 of the inner surface of the roller 12.

The cam 44 is also adapted to slide laterally on the right end portion 29 of the center rod 28, so that its longitudinally-projecting pawl 74 can follow the guide channel 52 of the disc 42. In this regard, FIG. 6A shows the cam 44 in its most rearward position, in which its pawl 74 is in position P2 (in FIG. 5) at the rear of the guide channel 52 of the disc 42, and FIG. 6B shows the cam 44 in its most frontal position, in which its pawl 74 is in position P3 (in FIG. 5) at the front of the guide channel 52 of the disc 42.

Figure 7:
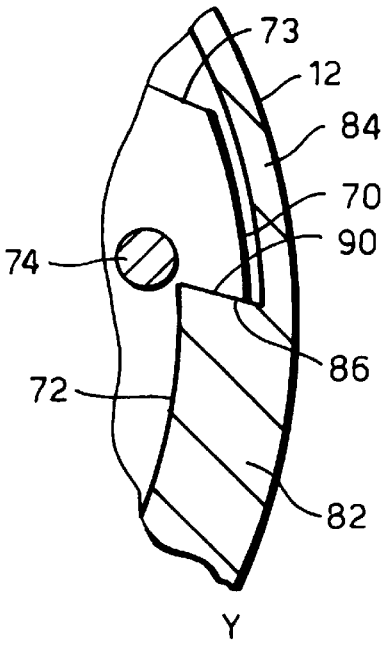
FIG. 7 is an enlarged view of an area "Y" in FIG. 6B, showing the interaction of the locking device and the roller.

FIG. 7 shows in detail the cooperation between the outer cam projection surface 70 and the first inner cam surface 72 of the frontally-extending radial surface 66 of the cam 44 and the detent projections 82 of the second portion 12B of the inner surface of the roller 12. The clockwise side 90 of the outer cam projection surface 70 is shown hooking the counter-clockwise side 86 of one of the detent projections 82 as in FIG. 6B, whereby the outer cam projection surface 70 holds securely the one detent projection 82 against further rotation of it and the roller 12 in the counter-clockwise direction of arrow B in FIGS. 4–6. However, the outer cam projection surface 70 does not significantly restrain any of the detent projections 82, as in FIG. 6A, against further rotation with the roller 12 in the clockwise direction of arrow A in FIGS. 4–6.

The following is a description of the operation of the locking device 38 of this invention, starting with the blind 1 being completely rolled-up. In this starting position, the pawl 74 of the cam 44 is in position P1 in the guide channel 52 of the disc 42 in FIG. 5.

When the pawl 74 is in position P1, the transverse position of the outer cam projection surface 70 of the frontally-extending radial surface 66 of the cam 44 is such that its clockwise side 90 does not hook the counter-clockwise side 86 of any of the detent projections 82 of the second portion 12B of the inner surface of the roller 12, and the roller 12 can freely rotate in the direction of arrow A in FIGS. 4–6.

When the pull-tab 18 of the shade 16 is pulled down initially, the roller 12 rotates in the direction of arrow A in FIGS. 4–6 about the center rod 28. The disc 42 will then begin to rotate about the center rod 28 in the same direction of arrow A as the roller 12, due to the frictional engagement of the ball 49 in the cavity 47 of the disc with the first portion 12A of the inner surface of the roller. Such rotation of the disc 42 will then cause a first surface 54A of the guide channel 52 of the disc 42 to push the pawl 74 of the cam 44, so that the pawl is moved in the direction of arrow A along the first guide channel surface 54A from position P1 to position P2 in FIG. 5. As the pawl 74 is forced to move by the first guide channel surface 54A towards position P2, the cam 44 moves transversely, preferably rearwardly, towards the axial center of the roller 12, over the parallel flat, preferably top and bottom, surfaces 29A of the flattened right end portion 29 of the fixed center rod 28 and between the facing parallel surfaces of the two partly cylindrical projections 78*a* and 78*b* of the cam retainer 46. As a result, the outer cam projection surface 70 of the frontally-extending radial surface 66 of the cam 44 is moved transversely even farther away from the detent projections 82 on the second portion 12B of the inner surface of the roller 12, and the roller can continue to rotate freely in the direction of arrow A.

When the pull-tab 18 of the shade 16 is pulled further down and the roller 12 continues to rotate in the direction of arrow A, the cam 44 exerts a force on the disc 42, via the pawl 74 and the position P2 of the guide channel 52, to stop further rotation of the disc in the direction of arrow A. This stopping force is due to the cam 44 being non-rotatably held on the flattened right end portion 29 of the fixed center rod 28 by its parallel surfaces 29A and preferably also by the cylindrical projections 78*a* and 78*b* of the cam retainer 46 and because the pawl 74 of the cam 44 cannot be moved further rearwardly in the guide channel 52 than its position P2 in response to any further rotation of the disc 42 in the direction of arrow A. Although the pawl 74 of the cam 44 stops the further rotation of the disc 42, the roller 12 continues to rotate in the direction of arrow A under the force of the shade 16 being pulled down, notwithstanding the frictional braking effects of the ball 49 that is being pushed radially outwardly against the first portion 12A of the inner surface of the roller 12 by the compression spring 48 in the cavity 47 of the disc 42.

When the pull-tab 18 of the shade 16 is subsequently released, the roller 12 starts to move in the direction of arrow B in FIGS. 4–6 under the influence of the return spring 32, and the shade moves upwardly. When this happens, the force of the ball 49 being pushed by the compression spring 48 against the first portion 12A of the inner surface of the roller 12 causes the disc 42 to frictionally engage the roller and to rotate with it in the direction of arrow B. This causes a second surface 54B of the guide channel 52 of the disc 42 to push the pawl 74 of the cam 44 in the direction of arrow B, so that the pawl 74 is moved along the second guide channel surface 54B from position P2 to position P3 in FIG. 5. As the pawl 74 is moved towards position P3, the cam 44 slides transversely, preferably frontally, away from the axial center of the roller 12, over the parallel flat surfaces 29A of the flattened right end portion 29 of the center rod 28 and between the facing parallel surfaces of the two partly cylindrical projections 78*a* and 78*b* of the cam retainer 46, thereby moving the outer cam projection surface 70 of the frontally-extending radial surface 66 of the cam 44 transversely, preferably frontally, towards and into a locked position with one of the detent projections 82 on the second portion 12B of the inner surface of the roller 12. In this locked position as shown in FIGS. 6B and 7, the clockwise side 90 of the outer cam projection surface 70 hooks the counter-clockwise side 86 of one of the detent projections 82, and the shade 16 stops moving upwardly. The actual distance that the shade 16 moves upwardly after its pull-tab 18 is released and before it is stopped by the locking device 38 can be made very small and is preferably less than about ¼th of a turn of the roller 12.

When the shade 16 is to be completely rolled up, its pull-tab 18 is pulled downwardly from its locked position and is then moved upwardly. Pulling the shade downwardly rotates roller 12 a short distance in the direction of arrow A. The flats 84 between the detent projections 82 on the second portion 12B of the inner surface of the roller 12 are large enough to allow the roller to rotate such a short distance around the cam 44 in the direction of arrow A, thus unlocking the outer cam projection surface 70 of the cam 44 from the detent projections 82. This short movement of the roller 12 also causes the disc 42 to rotate in the direction of arrow A as a result of the ball 49 being pushed by the compression spring 48 against the first portion 12A of the inner surface of the roller 12 and thereby frictionally engaging the roller. The resulting movement of the disc 42 causes a third surface 54C of the guide channel 52 of the disc to push the pawl 74 of the cam 44 in the direction of arrow A, so that the pawl 74 is moved along the third guide channel surface 54C from position P3 to position P4 in FIG. 5. As the pawl 74 moves towards position P4, the cam 44 slides transversely, preferably rearwardly, towards the axial center of the roller 12, over the parallel flat surfaces 29A of the flattened right end portion 29 of the center rod 28, thereby moving transversely, preferably rearwardly, the outer cam projection surface 70 of the cam 44, so that it does not hook any of the projections 82 of the second portion 12B of the inner surface of the roller 12, as it rotates. The roller 12 is then unlocked, and the shade 16 can roll up under the biasing force of the return spring 32 in the direction of arrow B.

As the roller 12 then rotates in the direction of arrow B to roll up the shade 16, movement of the roller causes the disc 42 also to rotate in the direction of arrow B as a result of the ball 49 being pushed by the compression spring 48 against the first portion 12A of the inner surface of the roller 12 and thereby frictionally engaging the roller. The resulting movement of the disc 42 causes a fourth surface 54D of the guide channel 52 of the disc 42 to push the pawl 74 of the cam 44 in the direction of arrow B, so that the pawl 74 is moved along the fourth guide channel surface 54D from position P4 to position P1 in FIG. 5. As the pawl 74 moves towards position P1, the cam 44 slides somewhat transversely, preferably rearwardly, towards the axial center of the roller 12, over the parallel flat surfaces 29A of the flattened right end portion 29 of the center rod 28, thereby moving the outer cam projection surface 70 of the cam 44 somewhat transversely, preferably rearwardly. The position P1 of the pawl 74 ensures that outer cam projection surface 70 does not hook any of the detent projections 82 on the second portion 12B of the inner surface of the roller 12, as it rotates. While the roller 12 continues to rotate in the direction of arrow B, the cam 44 (which is non-rotatably fixed to the flattened right end portion 29 of center rod 28) exerts a force, via the pawl 74 and position P1 of the guide channel 52, on the disc 42 that will stop the rotation of the disc 42. The roller 12 will continue, however, to rotate relatively freely under the force of the return spring 32, despite the ball 49 that is being pushed radially outwardly by the compression spring 48 to frictionally engage the first portion 12A of the inner surface of the roller. So while the shade is being wound up, the disc 42 is stationary, and the roller 12 rotates relatively freely.

This invention is, of course, not limited to the above-described embodiment which can be modified without departing from the scope of the invention or sacrificing all of its advantages. In this regard, the terms in the foregoing description and the following claims, such as "left", "right", "frontally", "rearwardly", "inwardly", "radially", "laterally", "longitudinally", "bottom", "top", "vertically", "axial", "side" and "end", have been used only as relative terms to describe the relationships of the various elements of the locking device of the invention for rollers of architectural coverings. For example, the cavity 47 and its compression spring 48 and ball 49 could be replaced by other means of yieldingly engaging the disc 42 to rotate with the first portion 12A of the inner surface of the roller 12 in either of two opposite rotational directions (indicated by arrows A and B in FIGS. 4–6), such as by magnetic means or by a silicone grease between the disc and the inner surface of the roller. Also, although at least one detent projection 82 on the second portion 12B of the inner surface of the roller 12 is necessary to interact with the outer cam projection surface 70 of the cam 44, a plurality of circumferentially spaced detent projections 82 are preferred on the second portion 12B of the inner surface of the roller 12 in order to enable the locking device 38 to stop the shade 16 from moving upwardly more quickly after the release of its pull-tab 18.

Furthermore, it is preferred that a plurality, preferably three, guide channels 52 are provided in the right axial face 51 of the disc 42. These guide channels 52 are symmetrically located about the bearing hole 50 in the disc 42. This facilitates the registration of the pawl 74 within one of the guide tracks 52 when assembling the locking device 38.

Although the present invention has been described in relation to a hollow tubular winding roller for directly winding or unwinding of a shade thereabout, it is also known to retract or lower a blind or shade device indirectly by means of lift cords being wound or unwound about a winding shaft. In such an arrangement, winding shafts conceivably do not always need to be hollow or tubular, provided there is a hollow end portion on or connected to it, which provides an inner surface thereon to accommodate and engage the cam member to releasably lock the winding shaft or roller in any position of the shade.

While embodiments and applications of the present invention have been shown and described, it would be apparent to one skilled in the art that other modifications are possible without departing from the inventive concepts herein. The invention, therefore, is not to be restricted except in the spirit of the claims that follow.

What is claimed is:

1. A locking device (38) for locking a longitudinally extending roller (12) for a shade (16) of an architectural covering (1), the roller (12) having a circumferential inner surface, said locking device (38) comprising:

a center shaft (28) concentrically arranged within the roller;

a return spring (32), capable of being operatively interposed between the roller (12) and said center shaft (28), for biasing the roller (12) towards a retracted position of the shade (16);

a disc (42) rotatably mounted on said center shaft (28) radially adjacent a first portion (12A) of the circumferential inner surface on the roller (12);

at least one detent projection (82, 86) on a second portion (12B) of the circumferential inner surface on the roller (12);

a cam member (44), mounted on said center shaft (28), so as to be able to carry out sliding movement transversely of said center shaft (28), between two end positions; said cam member (44) having a lateral cam projection (70, 90) for engaging said detent projection (82, 86); and means (47, 48, 49), between said disc (42) and the roller (12), for yieldingly engaging the disc (42) to rotate with the roller (12) in either of two opposite rotational directions;

said disc (42) having a face (51) that confronts said cam member (44) and is provided with a guide track (52); and said cam member (44) being provided with a pawl (74) engaged in said guide track (52) to move said cam member (44) between said two end positions in response to changes in rotational direction of the roller, whereby the roller may be locked releasably in any position of the shade.

2. The locking device according to claim 1 wherein said means (47, 48, 49) for yieldingly engaging said disc (42) to rotate with the roller (12) is a friction means.

3. The locking device according to claim 2 wherein said friction means for yieldingly engaging said disc (42) to rotate with the roller (12) includes a cylindrical cavity (47) housing a coaxially-extending compression spring (48) and a ball (49), radially outwardly of said compression spring; said ball being biased against, and frictionally engaging, said first portion (12A) of the circumferential inner surface on the roller (12).

4. The locking device according to claim 1 wherein said cam member (44) is mounted on a longitudinal end portion (29) of said center shaft (28) having parallel flat surfaces (29A) on opposite longitudinal sides of said longitudinal end portion (29).

5. The locking device according to claim 4 wherein said longitudinal end portion (29) has opposite top and bottom horizontally-extending longitudinal sides comprising said parallel flat surfaces (29A).

6. The locking device according to claim 4 wherein said cam member (44) has an elongate longitudinally-extending opening (68) through it with a first transverse length that is longer than a second transverse length of said longitudinal end portion (29) of said center shaft (28) that is accommodated in said elongate opening (68), and wherein said elongate opening (68) has a first width corresponding substantially to a second width across said parallel flat surfaces (29A) of said longitudinal end portion (29), so that said cam member (44) cannot rotate about said center shaft (28) but can slide transversely on said parallel flat surfaces (29A).

7. The locking device according to claim 1 wherein said locking device (38) further includes a cam retainer (46) that is fixedly mounted on said center shaft (28) and has transversely spaced apart, axially-extending projections (78*a,* 78*b*); said projections (78*a,* 78*b*) being positioned transversely of and adjacent to spaced parallel surfaces (56, 58) on transversely opposite sides of said cam member (44); and said projections (78*a,* 78*b*) being adapted to slidingly guide said parallel surfaces (56, 58) between them so that said cam member (44) cannot rotate about said center shaft (28) but can slide transversely on said parallel flat surfaces (29A).

8. The locking device according to claim 7 wherein said cam member (44) has a top and bottom, and said spaced parallel surfaces (56, 58) are on said top and bottom of said cam member (44), and wherein said projections (78*a,* 78*b*) are spaced vertically above and below said spaced parallel surfaces (56, 58) so that said cam member (44) can slide laterally on said parallel flat surfaces (29A).

9. The locking device according to claim 1 wherein said second portion (12B) of the length of the inner surface on the roller (12) has a plurality of said detent projections (82, 86).

10. The locking device according to claim 9 wherein said detent projections (82, 86) are integrally formed on the roller (12).

11. The locking device according to claim 1 wherein said guide track (52) forms a closed loop in said face (51) of said disc (42); said loop not circumambulating an elongate longitudinally-extending opening (50) through said disc (42), and wherein said opening accommodates said center shaft (28).

* * * * *